US006234819B1

(12) United States Patent
Oka

(10) Patent No.: US 6,234,819 B1
(45) Date of Patent: May 22, 2001

(54) MECHANISM FOR DETECTING AN UNLOCKED STATE OF CONNECTORS

(75) Inventor: Hiroyuki Oka, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/641,928

(22) Filed: Aug. 17, 2000

(30) Foreign Application Priority Data

Aug. 17, 1999 (JP) ..... 11-230368

(51) Int. Cl.[7] ..... H01R 4/38
(52) U.S. Cl. ..... 439/321; 439/489; 439/317
(58) Field of Search ..... 439/321, 317, 439/319, 488, 489

(56) References Cited

U.S. PATENT DOCUMENTS 3,869,186 * 3/1975 Vetter ..... 439/321
4,239,315 * 12/1980 Lacaze, Jr. ..... 439/489
4,255,008 * 3/1981 Synder et al. ..... 439/321
4,322,121 * 3/1982 Riches et al. ..... 439/489
4,373,770 * 2/1983 Raux et al. ..... 439/489

FOREIGN PATENT DOCUMENTS 4-132178 5/1992 (JP) .

* cited by examiner

*Primary Examiner*—Gary F. Paumen
*Assistant Examiner*—Tho D. Ta
(74) *Attorney, Agent, or Firm*—Oliff & Berridge, PLC

(57) ABSTRACT

An electrical connector has first and second matable connector housings with circular cross-sections, and has a fixing ring which is rotatably mounted at an outer circumference of the first connector housing. In use, the fixing ring is engaged with the second connector housing to form a screw-action cam mechanism. This draws the connector housings into mating engagement when the fixing ring is rotated in a first rotational direction relative to the connector housings. The connector also has (i) a detent for detaining the fixing ring at a predetermined position corresponding to full mating engagement of the connector housings, and (ii) a return spring which applies a return bias to the fixing ring in the opposing rotational direction as the fixing ring is rotated in the first rotational direction.

4 Claims, 7 Drawing Sheets

MECHANISM FOR DETECTING AN UNLOCKED STATE OF CONNECTORS

BACKGROUND OF THE INVENTION

1. Field of the Invention

The present invention relates to an electrical connector in which a pair of connector housings containing electrical terminals are fitted to each other, typically with a relatively low force. Such a connector is used for example to connect wire bundles in a motor vehicle.

2. Description of the Related Art

An example of a connector of this type is disclosed in JP-A-4-132178. The connector has a pair of female and male circular cross-section connector housings to be fitted to each other. A fixing ring is installed on a peripheral surface of the female housing such that the fixing ring is freely rotatable. A follower pin projects inwardly from the fixing ring. A cam groove is formed on a peripheral surface of the male housing. The housings are temporarily fitted to each other by engaging the follower pin to the cam groove. Then, the fixing ring is rotated, and as a result the housings arrive at the fully fitted state by the camming action of the follower pin in the cam groove.

In the above-described connector, the fixing ring is rotated to a predetermined position and locked, and an operator then determines if the housings are fully fitted. However, when the fixing ring is rotated to a position close to the predetermined position, fitting resistance may be generated (although the degree of the resistance is generally low). Thus, there is a possibility that the operator stops rotating the fixing ring before the housings are fully fitted. That is, the housings may be held in an incompletely fitted state. It may be very difficult for the operator to detect this.

SUMMARY OF THE INVENTION

It is an object of the present invention to provide a connector which allows an operator to detect whether the connector housings have been fully fitted to each other.

The present invention provides a connector having first and second matable connector housings with circular cross-sections, and a fixing ring which is rotatably mounted at an outer circumference of the first connector housing. In use, the fixing ring is engaged with the second connector housing to form a screw-action cam mechanism which draws the connector housings into mating engagement when the fixing ring is rotated in a first rotational direction relative to the connector housings. The connector further has a detent for detaining the fixing ring at a predetermined position corresponding to full mating engagement of the connector housings. The connector also has at least one return spring which applies a return bias to the fixing ring in a second rotational direction opposite to said first rotational direction as the fixing ring is rotated in the first rotational direction.

Preferably, the return spring is a coil spring which is accommodated in a circumferential groove formed in the first connector housing inwardly of the fixing ring, and a loading member is operably connectable to the fixing ring and projects into the circumferential groove. Therefore, when the fixing ring is rotated in the first rotational direction, the loading member travels around the circumferential groove to load the coil spring and generate the return bias.

Preferably, the loading member projects inwardly from a loading ring which is rotatably mounted between the fixing ring and the circumferential groove. The fixing ring has a resiliently deformable latching arm which is engageable with a corresponding portion of the loading ring to operably connect the loading member to the fixing ring. The detent is preferably provided by the latching arm and a locking projection formed on the first connector housing. When the fixing ring reaches the predetermined position of full engagement, to detain the fixing ring the latching arm engages the locking projection with a latching action which involves a deformation of the latching arm. This deformation also disengages the latching arm from the corresponding portion of the loading ring to release the coil spring and at least partially remove the return bias.

Preferably, the latching arm and locking projection are adapted so that when at least a predetermined force is applied to the fixing ring to rotate the fixing ring in the opposite rotational direction, the latching arm disengages from the locking projection.

As described above, according to the present invention, by rotating the fixing ring, the connector housings are fitted to each other. However, if rotation of the fixing ring is stopped before the fixing ring is locked by the detent, the fixing ring when released rotates in the opposite direction by the elastic restoring force of the return spring so that the connector housings separate from each other. Thereby, it is possible to detect whether the housings are fully engaged.

When a coil spring is used for the return spring, it is possible to provide a compact connector.

BRIEF DESCRIPTION OF THE DRAWINGS

Embodiments of the invention will now be described by way of non-limitative example, with reference to the accompanying drawings, in which.

DETAILED DESCRIPTION OF THE PREFERRED EMBODIMENTS

Figure 1:
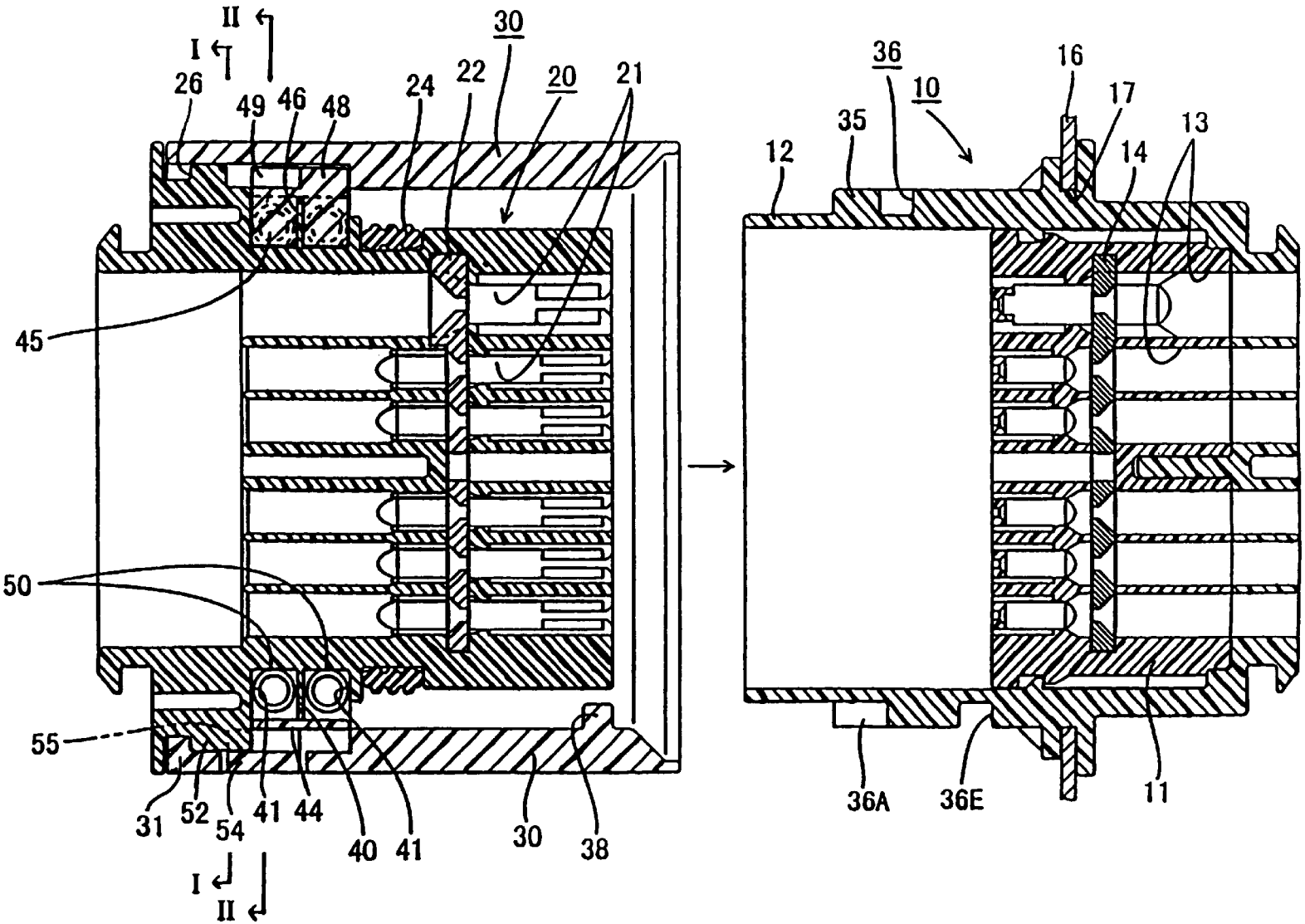
FIG. 1 is a longitudinal cross-sectional view of a connector embodying the invention showing housings before they are fitted to each other.

As shown in FIG. 1, the connector has a male connector housing 10 (hereinafter referred to as male housing 10) and a female connector housing 20 (hereinafter referred to as female housing 20) to be fitted in the male housing 10.

In the description below, the side of each of the male and female housings 10 and 20 which is fitted to the other housing is called the front side.

The male housing 10 is formed by combining two pieces made of synthetic resin with each other. More specifically, the male housing 10 has a body part 11 of circular cross-section and a cylindrical hood part 12 projecting forward from the body part 11. The male housing 10 is shown installed in an installing hole 17 of a panel 16 of, for example, a motor vehicle (not shown) in preparation for engagement with the female housing 20.

A plurality of cavities 13 is formed in the body part 11. Male terminal metal fittings (not shown) are inserted into respective cavities 13 from the rear end thereof and are held therein, and have tabs which project into the hood part 12. The male terminal metal fittings are locked by retainers 14 to prevent removal of the fittings from the cavities 13.

The female housing 20 is also made of synthetic resin and is of general circular cross-section. The front side of the female housing 20 can be fitted in the hood part 12 of the male housing 10.

A plurality of cavities 21 is formed in the female housing 20 such that the cavities 21 confront the cavities 13 of the male housing 10. Female terminal metal fittings (not shown) are inserted into respective cavities 21 from the rear end thereof and are held therein. The female terminal metal fittings are locked by retainers 22 to prevent removal of the fittings from the cavities 21.

Figure 2:
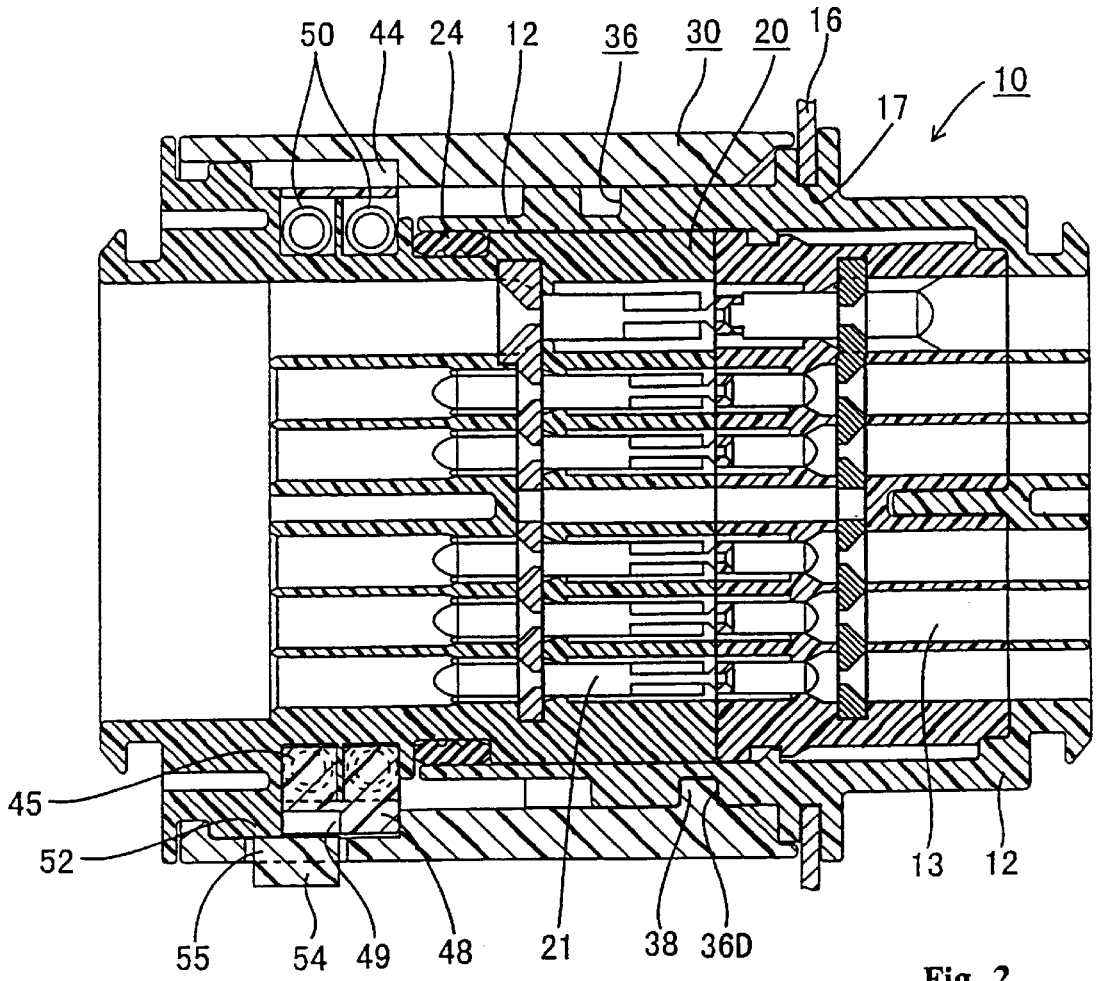
FIG. 2 is a longitudinal cross-sectional view showing the housings of FIG. 1 immediately before being fitted to each other.

An outer circumferential seal ring 24 is installed midway along the female housing 20. The seal ring 24 is elastically sandwiched between the outer surface of the female housing 20 and the front side of the hood part 12 when the male housing 10 and the female housing are engaged with each other (see FIG. 2).

A fixing ring 30 is also made of synthetic resin and is cylindrical. The fixing ring 30 can be fitted on the periphery of the female housing 20, with a predetermined clearance provided between the fixing ring 30 and the periphery of the female housing 20. A plurality of circumferentially-spaced, inwardly-projecting locking hooks 31 are formed at the rear side of the fixing ring 30. The locking hooks 31 are fitted in a circumferential groove 26 formed at the rear side of the peripheral surface of the female housing 20, and in this way the fixing ring 30 is supported on the peripheral surface of the female housing 20 such that the fixing ring 30 can rotate freely.

Figure 3:
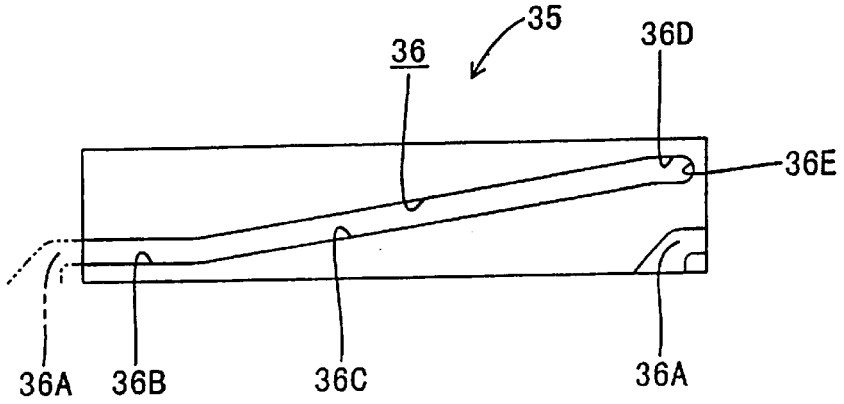
FIG. 3 is a view of a circumferential surface of one of the housings projected onto the plane of the page and showing a cam groove.

A shoulder 35 is formed at the root (front) side of the peripheral surface of the hood part 12 of the male housing 10. As shown in FIG. 3, a cam groove 36 is formed in the shoulder 35. The start portion 36A of the cam groove 36 opens to the front edge of the shoulder 35. An inclined portion 36C of the groove extends between a first linear portion 36B and a second short linear portion 36D. The end of the second linear portion 36D forms a termination portion 36E. The start portion 36A and the termination portion 36E circumferentially overlap each other.

A follower pin 38 that can be received in the cam groove 36 projects from the front end of the inner surface of the fixing ring 30.

Although a detailed description is not provided here, the fixing ring 30 can be temporarily held, by an operator's fingers, for example, on the female housing 20 in a predetermined rotational position, and by aligning marks formed on the fixing ring 30 and on the hood part 12 of the male housing 10, the cavities 13 of the male housing 10 and the cavities 21 of the female housing 20 can be put into alignment.

Next, the male housing 10 and the female housing 20 are fitted to each other. As a result, the follower pin 38 of the fixing ring 30 enters the start portion 36A of the cam groove 36.

A locking (detent) mechanism and a system for detecting incomplete engagement are provided by the female housing 20 and the fixing ring 30. The function of the locking mechanism is to lock the housings 10 and 20 to each other in a fully engaged state. The function of the system for detecting incomplete engagement is to provide an indication whether the housings 10 and 20 have been locked to each other in the fully engaged state. The locking mechanism and the system for detecting incomplete engagement are described below.

Figure 4A:
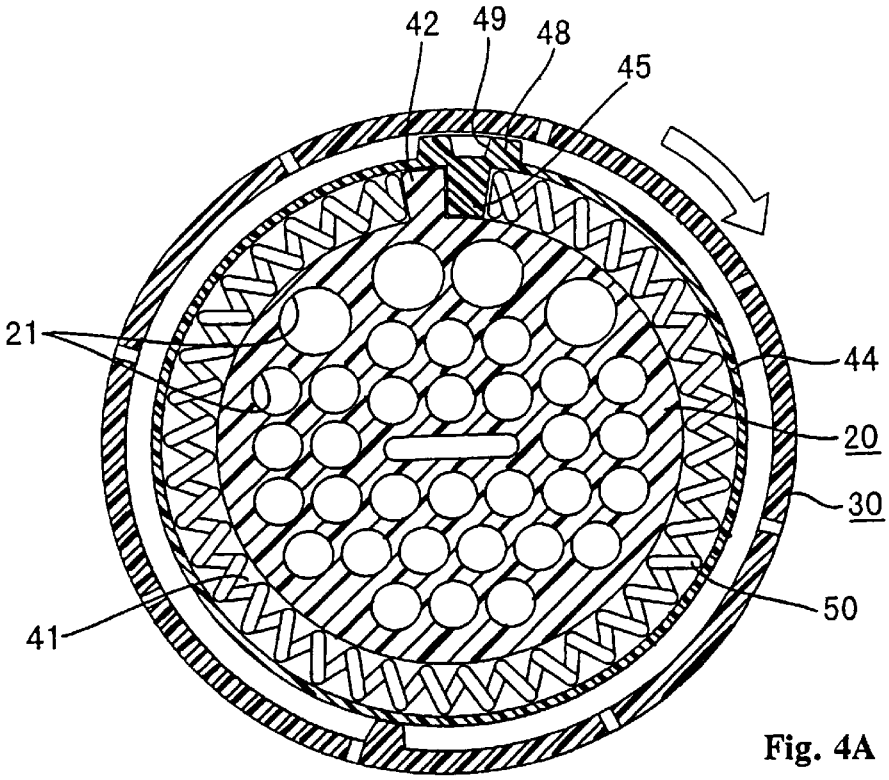
FIGS. 4A and 4B are transverse cross-sectional views at positions I—I and II—II respectively of FIG. 1 showing the female housing prior to engagement with the male housing.

Two circumferential spring accommodation grooves 41, spaced from each other with a partitioning wall 40, are formed on an outer surface of the female housing 20. The spring accommodation grooves 41 are located rearwardly from the seal ring 24. As shown in FIG. 4A, each spring accommodation groove 41 accommodates a spring seat 42.

A loading ring 44 is rotatably mounted on the periphery of each spring accommodation groove 41. A loading member 45 having a relief groove 46 to accommodate the partitioning wall 40 is formed at a predetermined position of the inner surface of the loading ring 44, such that the loading member 45 projects into the spring accommodation groove 41. A connection portion 48 to be connected with the fixing ring 30 projects outwardly from the loading member 45. An engagement concavity 49 is formed inwardly in the connection portion 48 at its rearward end.

Each spring accommodation groove 41 accommodates a coil spring 50, with one end of the coil spring 50 in contact with one surface of the spring seat 42 and the other end thereof in contact with the loading member 45. Thus, each coil spring 50 is accommodated in the respective spring accommodation groove 41, with the loading member 45 being pressed against an opposing surface of the spring seat 42.

Figure 4B:
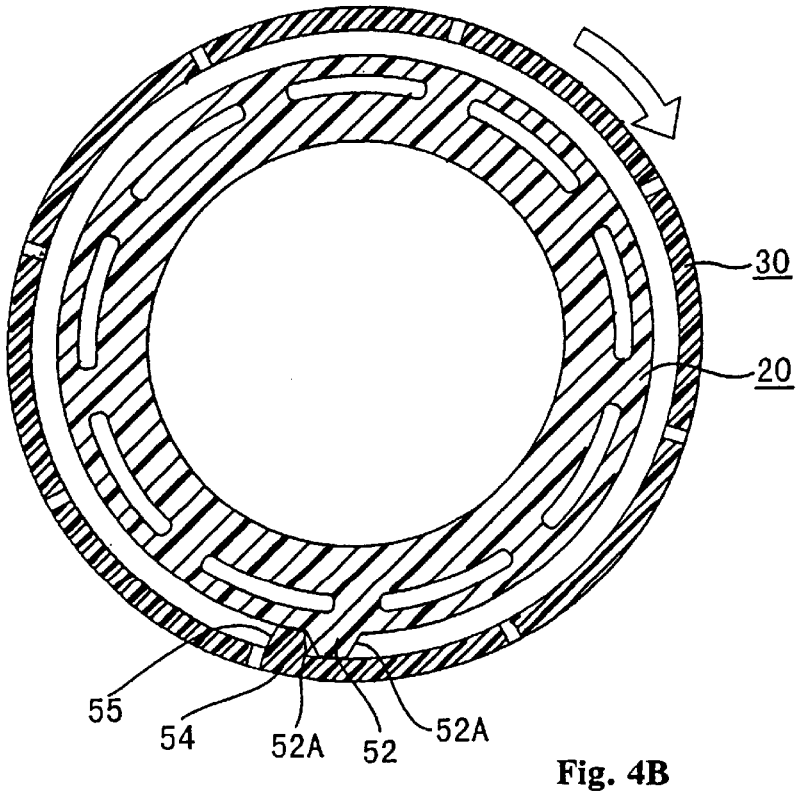

A locking projection 52 is formed on the peripheral surface of the female housing 20 rearwardly from the spring accommodation grooves 41 and circumferentially opposing the spring seat 42 as shown in FIG. 4B. The side surfaces 52A of the locking projection 52 converge toward each other. Thus, the locking projection 52 is tapered.

A locking arm 54 forms a portion of the fixing ring 30. As shown in FIG. 1, front and rear slits are formed in the fixing ring 30 to define the locking arm 54. The locking arm 54 radially overlaps the rearward spring accommodation groove 41 and (when aligned) the locking projection 52. As shown in FIG. 4B, the locking arm 54 extends clockwise and is cantilevered so that the front (free) end is displaceable radially outwardly when the locking arm 54 is elastically deformed.

A tapered projection 55 with converging side surfaces is formed at the front end of the inner surface of the locking arm 54 and extends across the whole width of the locking arm 54. In FIG. 4B, the rearward (relative to the front and rear ends of the housing 20) half of the projection 55 abuts the front side (relative to a clockwise rotational direction) of the locking projection 52. When the fixing ring 30 is temporarily held on the female housing 20 as described above, they assume this relative positioned relationship.

The forward half of the projection 55 in its widthwise direction fits in the engagement cavity 49 formed on a connection portion 48 of the fixing ring 30.

The operation of the connector of the first embodiment having the above-described construction is described below.

The male terminal metal fittings (not shown) are accommodated in the male housing 10 and are locked by the retainers 14. The male housing 10 is installed on an installing hole 17 of a panel 16 in preparation for engagement with the female housing 20.

The female terminal metal fittings (not shown) are accommodated in the female housing 20 and locked by the retainers 22. The fixing ring 30 is installed on the female housing 20 and is temporarily held at the predetermined position thereof, as described above.

A mark (not shown) on the fixing ring 30 and a mark (not shown) on the male housing 10 are then aligned with each other. Next, as indicated by the arrow of FIG. 1, the female housing 20 is pressed into the male housing 10. The female housing 20 is fitted in the hood part 12, with the cavities 21 thereof aligned with the cavities 13 of the male housing 10. As a result, the follower pin 38 of the fixing ring 30 penetrates into the start portion 36A of the cam groove 36. Then, the fixing ring 30 is rotated clockwise (as indicated by the arrows in FIGS. 4A and 4B). As a result, the follower pin 38 proceeds from the first linear portion 36B of the cam groove 36 to the inclined portion 36C thereof. Owing to the camming action of the follower pin 38 in the inclined portion 36C, the housings 10 and 20 are drawn toward each other.

Figure 5A:
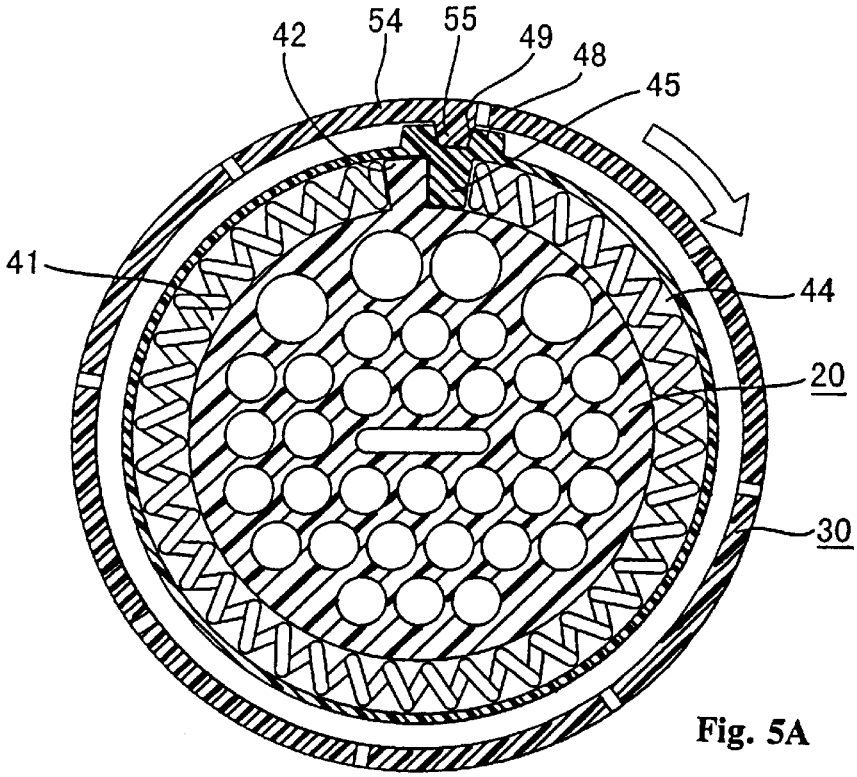
FIGS. 5A and 5B are transverse cross-sectional views similar to FIGS. 4A and 4B, but with the fixing ring rotated about half a turn.
Figure 5B:
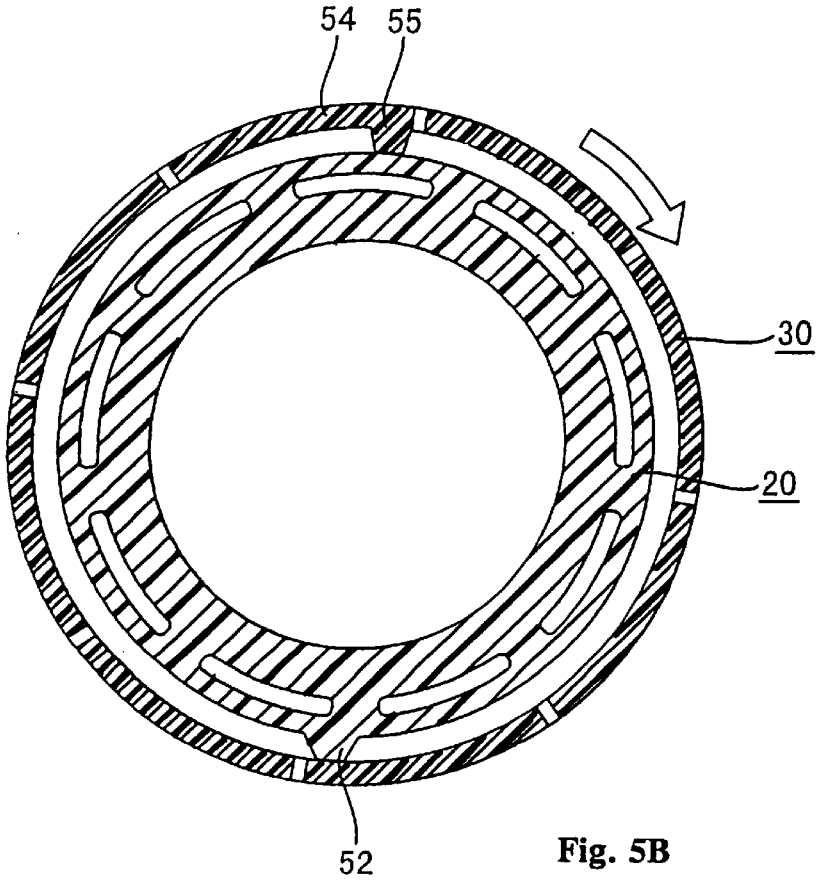

When the fixing ring 30 rotates about 180 degrees, the locking arm 54 elastically deforms as it rides over the connection portion 48 of the loading ring 44. Then, as shown in FIG. 5A, the locking arm 54 relaxes to fit projection 55 in the engagement concavity 49. In this way, the fixing ring 30 and the loading ring 44 are connected to each other so that they rotate together.

Figure 6A:
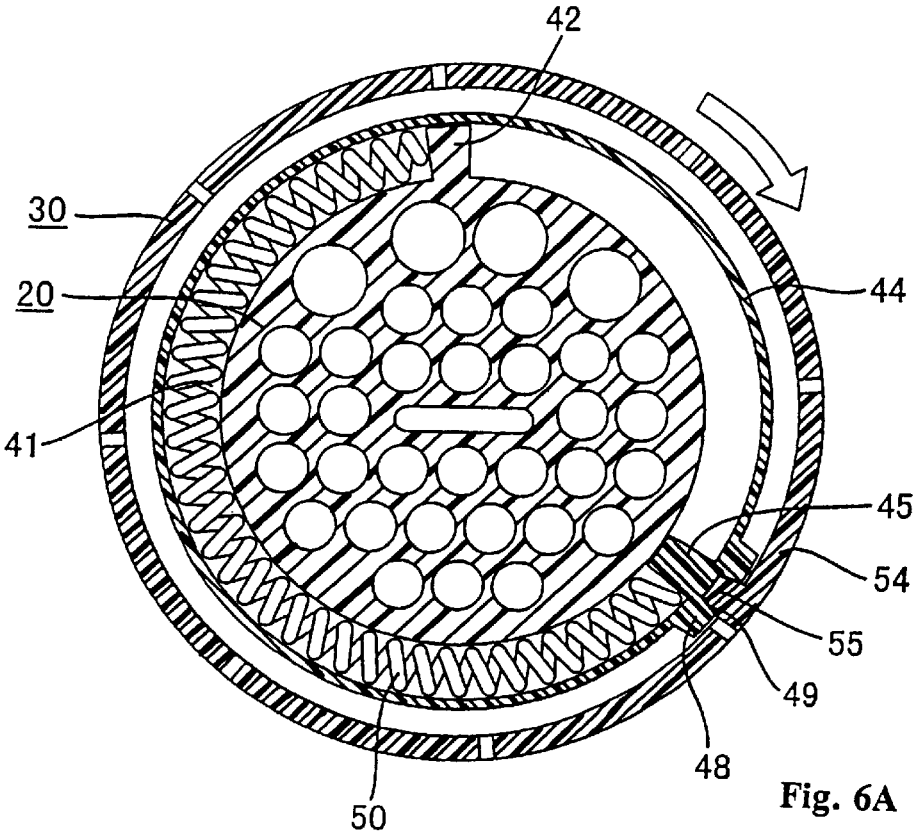
FIGS. 6A and 6B are transverse cross-sectional views similar to FIGS. 5A and 5B, but with the fixing ring rotated a further amount and engaging the coil spring.

With further rotation of the fixing ring 30, the housings 10 and 20 continue to be drawn together as the follower pin 38 travels along the cam groove 36. With this rotation of the loading ring 44, the coil springs 50 are gradually compressed by the loading member 45, as shown in FIG. 6A. This applies a return bias to the fixing ring 30.

Due to the camming action of the follower pin 38 in the cam groove 36, the housings 10 and 20 gradually approach the fully engaged position under a comparatively small applied rotational force. However, when the engagement operation approaches its final stage, the male terminal metal fittings of the male housing 10 and the female terminal metal fittings of the female housing 20 are deeply interconnected which increases resistance to further engagement. Thus, there is a possibility that an operator may stop rotating the fixing ring 30 before the housings 10 and 20 are fully engaged.

Figure 6B:
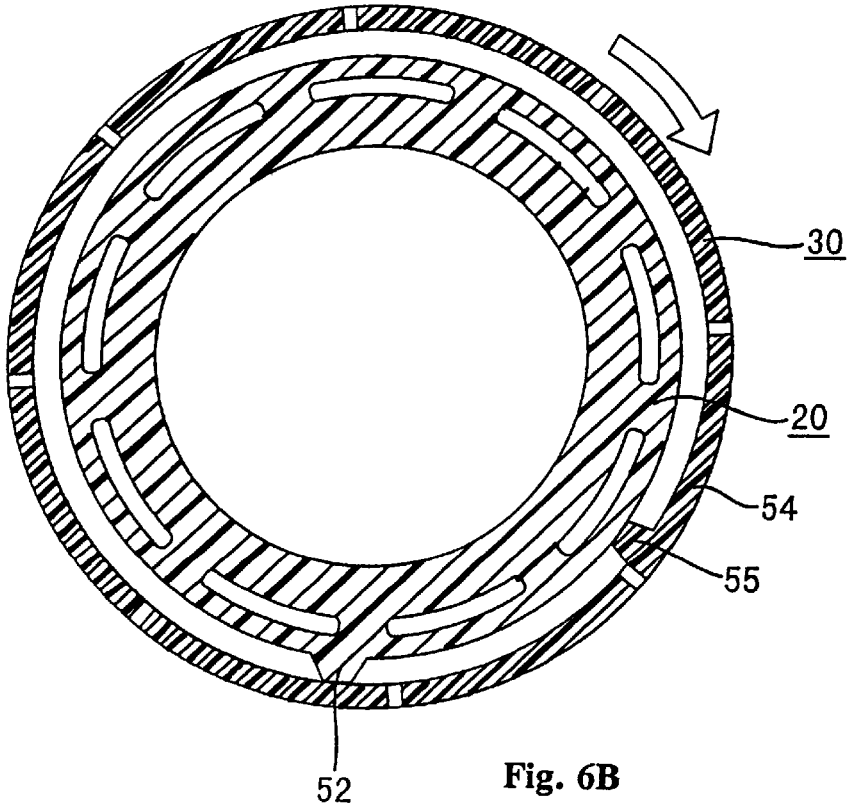

If this happens, and if the operator releases the fixing ring 30 or relaxes his or her grip on the fixing ring 30, the loading ring 44 and the fixing ring 30 are rotated together counterclockwise in FIG. 6 by the elastic restoring force of the compressed coil springs 50, and the housings 10 and 20 separate from each other. Therefore, the operator knows that the housings 10 and 20 were incompletely engaged.

Figure 7A:
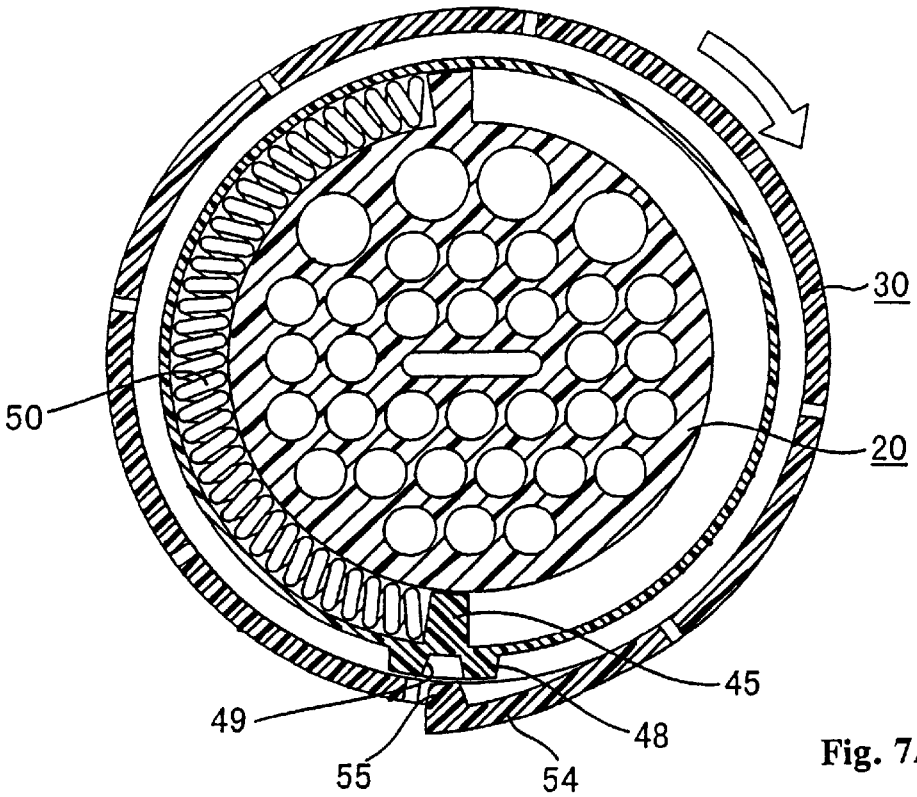
FIGS. 7A and 7B are transverse cross-sectional views similar to FIGS. 6A and 6B, but with the fixing ring rotated a still further amount and the coil spring in a relaxed state.
Figure 7B:
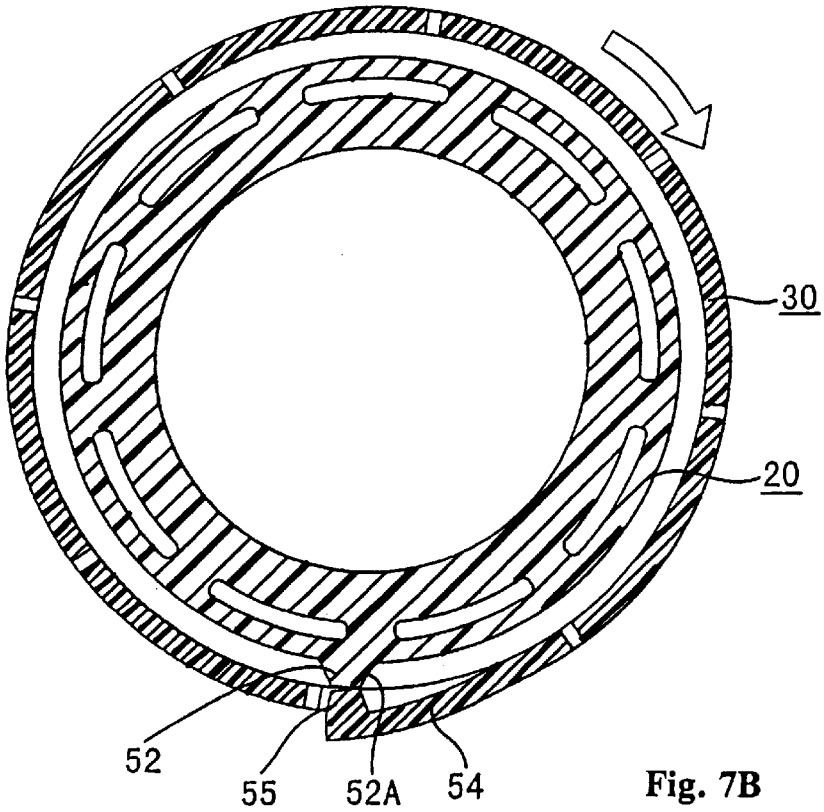

When the operator rotates the fixing ring 30 until it has made a 360 degree rotation, the follower pin 38 enters the second linear portion 36D of the cam groove 36, and the housings 10 and 20 are fully engaged. At the same time, as shown in FIG. 7B, the projection 55 of the locking arm 54 rides over the locking projection 52 of the female housing 20 and the locking arm 54 deforms outwardly elastically. Therefore, as shown in FIG. 7A, the projection 55 disengages from the engagement concavity 49 of the connection portion 48. Consequently the loading member 45 is no longer operatively connected to the fixing ring 30. As a result, as shown in FIG. 8A, the coil springs 50 recover their original elongation and rotate the loading ring 44 counterclockwise until the loading member 45 strikes the spring seat 42.

With a slight further rotation of the fixing ring 30, the projection 55 passes the locking projection 52. As a result, as shown in FIG. 8B, the locking arm 54 recovers its original form and is detained adjacent the locking projection 52. In this way, both housings 10 and 20 are held together in the fully engaged state.

Figure 8A:
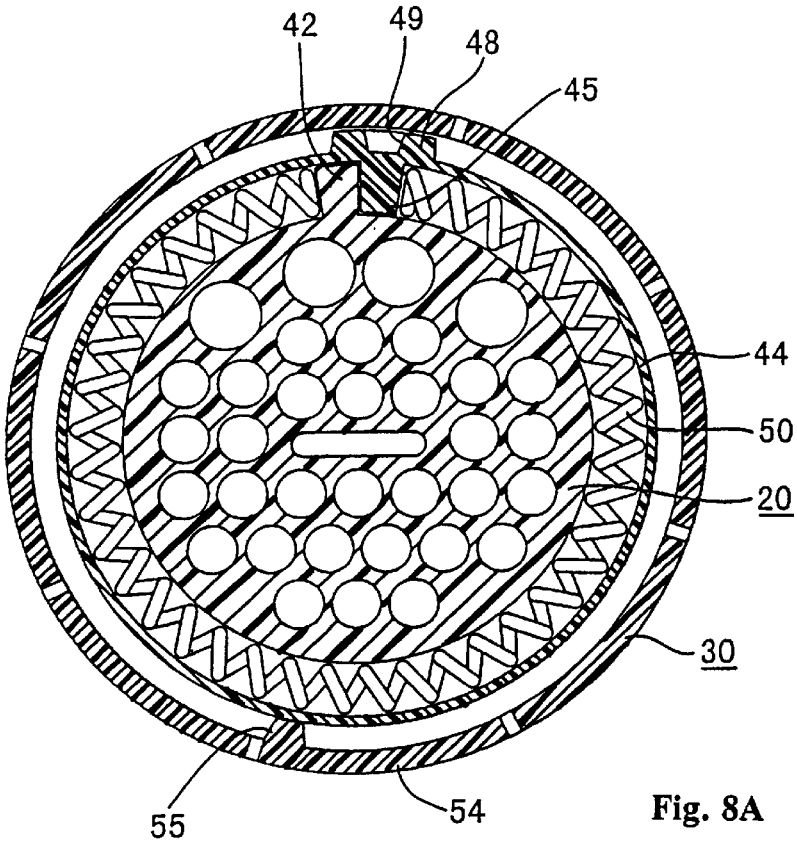
FIGS. 8A and 8B are transverse cross-sectional views similar to FIGS. 7A and 7B, but with the housings fully engaged with each other.
Figure 8B:
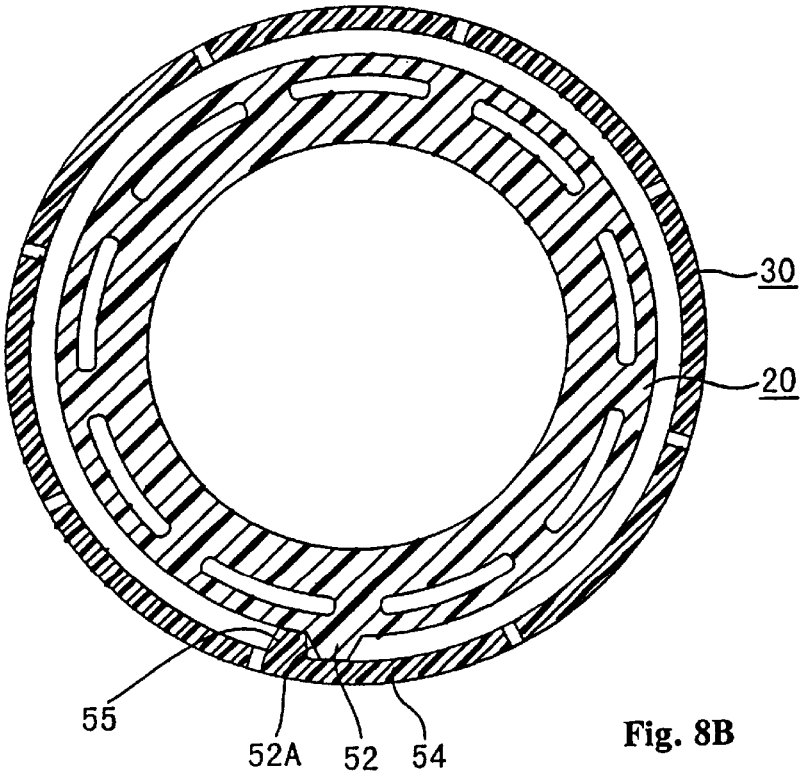

When the fixing ring 30 is rotated counterclockwise from the position of FIGS. 8A and 8B at a force greater than a predetermined force, the inclined surface 52A allows the projection 55 to ride back across the locking projection 52 in the opposite direction while the locking arm 54 is deformed elastically outwardly. Counterclockwise rotation of the fixing ring 30 continues until the projection 55 rides over the connection portion 48 (with a passing engagement) and disengages. Further counterclockwise rotation is not prevented. Meanwhile, both housings 10 and 20 are gradually separated from each other through the action of the follower pin 38 in the cam groove 36.

When the fixing ring 30 has made one full counterclockwise rotation and returned to the position at which the projection 55 contacts the locking projection 52, as shown in FIG. 4B, the follower pin 38 returns to the start portion 36A of the cam groove 36. This allows complete separation of the housings 10 and 20.

Slightly before the housings 10 and 20 become fully engaged, the coil springs 50 are unloaded and cause the loading ring 44 to rotate in the opposite direction (counterclockwise direction). Therefore, when the housings 10 and 20 are fully engaged, the spring force of the coil springs 50 no longer acts to separate the housings 10 and 20 from each other. However, the coil springs 50 are not disabled and can be reused.

Also the locking projection 52 has a semi-locking construction. That is, the locking arm 54 can ride across the locking projection 52 in both directions. Thus, when the fixing ring 30 is rotated in the counterclockwise direction at a force higher than a predetermined force, the fixing ring 30 escapes the detent, and then the fixing ring 30 can continue to be rotated to separate the housings 10 and 20.

The present invention is not limited to the embodiment explained above by way of the above description and drawings. For example, the following embodiments are included in the technical scope of the present invention.

(1) The coil spring can be a tension spring rather than a compression spring, allowing elastic restoring force to be stored as the spring is extended.

(2) The fixing ring may be mounted on the male housing. In this case, the locking mechanism and the coil spring are mounted between the male housing and the fixing ring.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

What is claimed is:

1. An electrical connector comprising:

first and second matable connector housings with circular cross-sections;

a fixing ring which is rotatably mounted at an outer circumference of said first connector housing, said fixing ring and said second connector housing being engageable to form a screw-action cam mechanism which draws said connector housings into mating engagement when said fixing ring is rotated in a first rotational direction relative to said connector housings;

a detent that detains said fixing ring at a predetermined position corresponding to full mating engagement of said connector housings; and at least one return spring which applies a return bias to said fixing ring in a second rotational direction opposite to said first rotational direction as said fixing ring is rotated in said first rotational direction.

2. An electrical connector according to claim 1, wherein said return spring is a coil spring which is accommodated in a circumferential groove formed in said first connector housing inwardly of said fixing ring, and said connector further comprises a loading member which is operably connectable to said fixing ring and projects into said circumferential groove, so that when said fixing ring is rotated in said first rotational direction said loading member travels around said circumferential groove to load said coil spring and generate said return bias.

3. An electrical connector according to claim 2, wherein said connector further comprises a loading ring which is rotatably mounted between said fixing ring and said circumferential groove, said loading member projecting inwardly from said loading ring, and said fixing ring having a resiliently deformable latching arm which is engageable with a corresponding portion of said loading ring to operably connect said loading member to said fixing ring, said detent being provided by said latching arm and a locking projection formed on said first connector housing, whereby when said fixing ring reaches said predetermined position, to detain said fixing ring said latching arm engages said locking projection with a latching action which involves a deformation of said latching arm, said deformation also disengaging said latching arm from said corresponding portion of said loading ring to release said coil spring and remove said return bias.

4. An electrical connector according to claim 3, wherein when at least a predetermined force is applied to said fixing ring to rotate said fixing ring in said opposite rotational direction, said latching arm disengages from said locking projection.

* * * * *